US005739759A

United States Patent [19]

Nakazawa et al.

[11] Patent Number: 5,739,759

[45] Date of Patent: Apr. 14, 1998

[54] MELODY PAGING APPARATUS

[75] Inventors: Takeo Nakazawa; Haruhiko Satoh, both of Hino, Japan

[73] Assignee: Toshiba Corporation, Kanagawa-ken, Japan

[21] Appl. No.: 660,412

[22] Filed: Jun. 7, 1996

Related U.S. Application Data

[63] Continuation of Ser. No. 313,237, filed as PCT/JP94/00145, Feb. 2, 1994 published as WO94/18760, Aug. 18, 1994, abandoned.

[30] Foreign Application Priority Data

Feb. 4, 1993 [JP] Japan ..... 5-017395

[51] Int. Cl.[6] ..... G08B 3/00; G08B 5/22

[52] U.S. Cl. ..... 340/825.44; 340/825.48

[58] Field of Search ..... 340/825.44, 825.46, 340/825.48; 455/38.1; 379/57

[56] References Cited

U.S. PATENT DOCUMENTS

| | | | |
|---|---|---|---|
| 4,417,246 | 11/1983 | Agnor | 340/825.44 |
| 4,804,955 | 2/1989 | Yoshizawa | 340/825.44 |
| 5,012,219 | 4/1991 | Henery | 340/825.44 |
| 5,233,344 | 8/1993 | Ohga | 340/825.44 |
| 5,307,059 | 4/1994 | Cannary | 340/825.44 |
| 5,332,994 | 7/1994 | Kawashima | 340/825.44 |

FOREIGN PATENT DOCUMENTS

| | | |
|---|---|---|
| 103087 | of 1982 | Japan . |
| 61-84931 | 4/1986 | Japan . |
| 317898 | of 1988 | Japan . |
| 63-185332 | 11/1988 | Japan . |
| 2-27821 | 1/1990 | Japan . |
| 2-130140 | 10/1990 | Japan . |
| 3-18136 | 1/1991 | Japan . |

OTHER PUBLICATIONS

"Motorola Advisor Message Receiver." 1990.

*Primary Examiner*—Brian Zimmerman

*Attorney, Agent, or Firm*—Finnegan, Henderson, Farabow, Garrett & Dunner, L.L.P.

[57] ABSTRACT

A calling radio wave from a base station is received by a receiving circuit through an antenna of a paging apparatus, and demodulated into a paging signal by a demodulator. If a call signal of the paging signal is determined as being addressed to the paging apparatus by a collator, then the collator determines a page type indicated by the caller based on a page type code at the beginning of a message contained in the paging signal, and outputs the page type to a controller. Based on the page type, the controller causes a speaker to output a melody, transmitting the caller's intention of the page to the carrier of the paging apparatus. A message other than the page type code is displayed on the screen of an LCD through an LCD driver.

17 Claims, 9 Drawing Sheets

FIG.4

| CALL SWITCHING MESSAGE | CALL TYPE |
|---|---|
| – 0 | VIBRATION |
| –1 | SPECIAL SOUND |
| – 2 | MELODY (TUNE 1) |
| – 3 | MELODY (TUNE 2) |
| – 4 | MELODY (TUNE 3) |
| – 5 | MELODY (TUNE 4) |
| – 6 | MELODY (TUNE 5) |
| – 7 | MELODY (TUNE 6) |
| – 8 | MELODY (TUNE 7) |
| – 9 | MELODY (TUNE 8) |

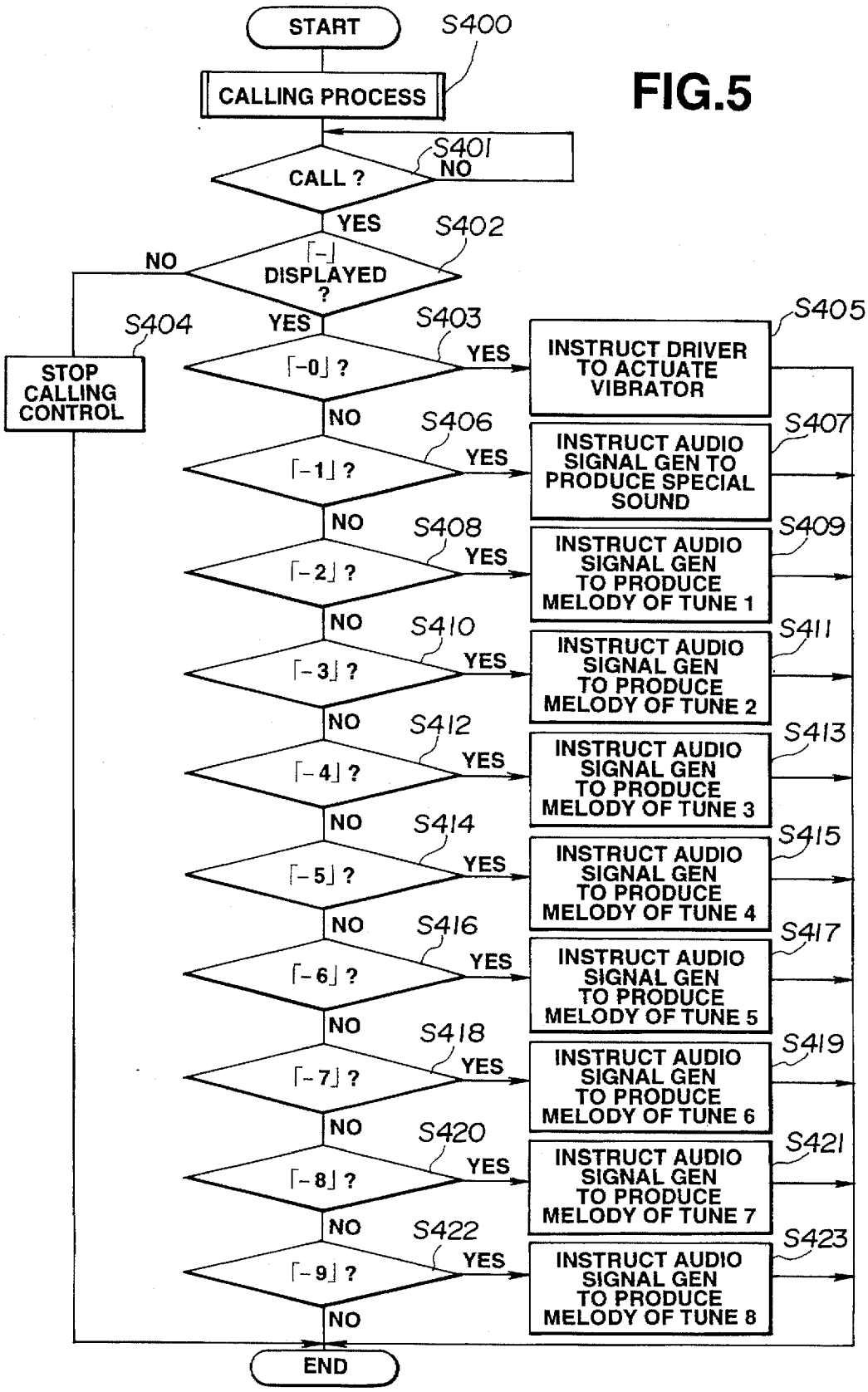
START
S400
CALLING PROCESS
FIG.5
S401
CALL ?
NO
YES
S402
NO
「-」 DISPLAYED ?
YES
S404
STOP CALLING CONTROL
S403
「-0」 ?
YES
S405
INSTRUCT DRIVER TO ACTUATE VIBRATOR
NO
S406
「-1」 ?
YES
S407
INSTRUCT AUDIO SIGNAL GEN TO PRODUCE SPECIAL SOUND
NO
S408
「-2」 ?
YES
S409
INSTRUCT AUDIO SIGNAL GEN TO PRODUCE MELODY OF TUNE 1
NO
S410
「-3」 ?
YES
S411
INSTRUCT AUDIO SIGNAL GEN TO PRODUCE MELODY OF TUNE 2
NO
S412
「-4」 ?
YES
S413
INSTRUCT AUDIO SIGNAL GEN TO PRODUCE MELODY OF TUNE 3
NO
S414
「-5」 ?
YES
S415
INSTRUCT AUDIO SIGNAL GEN TO PRODUCE MELODY OF TUNE 4
NO
S416
「-6」 ?
YES
S417
INSTRUCT AUDIO SIGNAL GEN TO PRODUCE MELODY OF TUNE 5
NO
S418
「-7」 ?
YES
S419
INSTRUCT AUDIO SIGNAL GEN TO PRODUCE MELODY OF TUNE 6
NO
S420
「-8」 ?
YES
S421
INSTRUCT AUDIO SIGNAL GEN TO PRODUCE MELODY OF TUNE 7
NO
S422
「-9」 ?
YES
S423
INSTRUCT AUDIO SIGNAL GEN TO PRODUCE MELODY OF TUNE 8
NO
END

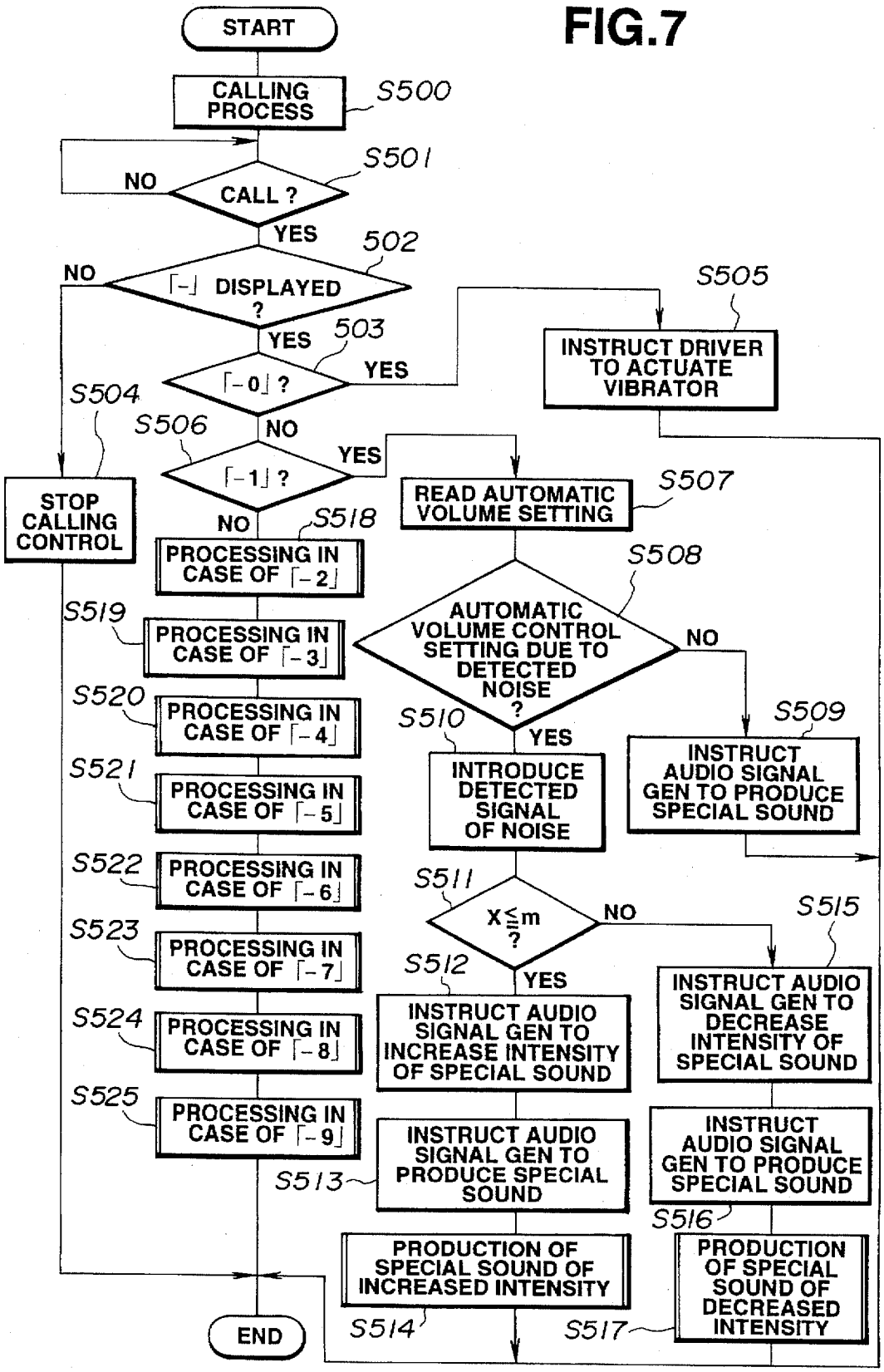
FIG.7
START
CALLING PROCESS
S500
CALL ?
S501
NO
YES
502
「-」 DISPLAYED ?
NO
YES
503
「-0」?
YES
NO
S504
S506
「-1」?
YES
NO
STOP CALLING CONTROL
S518
PROCESSING IN CASE OF 「-2」
S519
PROCESSING IN CASE OF 「-3」
S520
PROCESSING IN CASE OF 「-4」
S521
PROCESSING IN CASE OF 「-5」
S522
PROCESSING IN CASE OF 「-6」
S523
PROCESSING IN CASE OF 「-7」
S524
PROCESSING IN CASE OF 「-8」
S525
PROCESSING IN CASE OF 「-9」
END
S505
INSTRUCT DRIVER TO ACTUATE VIBRATOR
READ AUTOMATIC VOLUME SETTING
S507
S508
AUTOMATIC VOLUME CONTROL SETTING DUE TO DETECTED NOISE ?
NO
YES
S510
INTRODUCE DETECTED SIGNAL OF NOISE
S509
INSTRUCT AUDIO SIGNAL GEN TO PRODUCE SPECIAL SOUND
S511
X≦m ?
NO
YES
S512
INSTRUCT AUDIO SIGNAL GEN TO INCREASE INTENSITY OF SPECIAL SOUND
S515
INSTRUCT AUDIO SIGNAL GEN TO DECREASE INTENSITY OF SPECIAL SOUND
S513
INSTRUCT AUDIO SIGNAL GEN TO PRODUCE SPECIAL SOUND
INSTRUCT AUDIO SIGNAL GEN TO PRODUCE SPECIAL SOUND
S516
PRODUCTION OF SPECIAL SOUND OF INCREASED INTENSITY
S514
PRODUCTION OF SPECIAL SOUND OF DECREASED INTENSITY
S517

MELODY PAGING APPARATUS

This application is a continuation of application Ser. No. 08/313,237, filed as PCT/JP94/00145, Feb. 2, 1994 published as WO94/18760, Aug. 18, 1994, now abandoned.

FIELD OF THE INVENTION

The present invention relates to a paging apparatus for selecting various calling processes (hereinafter referred to as "call types") including special sound, vibration, melody, screen display, etc., to call a carrier of the paging apparatus.

DISCUSSION OF THE RELATED ART

Paging apparatus have been used as recent communication means. A paging apparatus receives a call from a caller through a radio communication network, and informs the carrier of the call by way of one or a combination of a special sound such as an intermittent sound, a melody, a vibrator's vibration, and a screen display of a telephone number or characters.

FIG. 1 of the accompanying drawings is a block diagram of an arrangement of a conventional paging receiver. In FIG. 1, a radio wave transmitted from a base station connected to a public radio telephone circuit network is received by an antenna 1, and the received signal is converted into an intermediate-frequency signal, for example, by a receiving circuit 2. Thereafter, the intermediate-frequency signal is demodulated by a demodulator 3, which outputs a paging signal. The paging signal is applied to a decoder 21 in a collator 4. The paging signal is composed of an identification number code assigned to the paging apparatus, a BCH code including a message code, and a parity bit.

The decoder 21 converts the identification number code in the paging signal into an identification number, and also converts the message code into a message. The converted identification number is stored in an address storage circuit 22, and the message is stored in a message storage circuit 23.

A comparator 24 compares the identification number stored in the address storage circuit 22 with the identification number of the paging apparatus which is stored in a memory 5, and outputs to a controller 12 a signal indicating that a call has been addressed to the present paging apparatus if the compared identification numbers agree with each other. Based on the supplied signal, the controller 12 reads the message stored in the message storage circuit 23, and sends the message through an LCD driver 6 to an LCD 7 for displaying the message, e.g., characters such as of the telephone number of a place to be called and comments, on a screen. At the same time that the characters are displayed, the controller 12 controls a melody generator 13 or a tone generator 14. A melody generated by the melody generator 13 or an intermittent sound generated by the tone generator 14 under the control of the controller 12 is sent to an audio signal generator 8, and outputted from a speaker 9. The controller 12 also controls a driver 10 to operate a vibrator 11 to cause the paging apparatus in part or whole to generate a vibration.

One or a combination of the call types, i.e., the display on the LCD 7, the melody produced by the melody generator 13, the special sound produced by the tone generator 14, and the vibration generated by the vibrator 11 is selected by the carrier of the paging apparatus who operates switches 15, and the selection is set in the controller 12. A call is made to the carrier based on the selection setting.

With the conventional paging apparatus, it is possible for the carrier to select and change call types on the paging apparatus. However, a caller who makes a call cannot designate a call type on the paging receiver to which the caller makes a call. A caller may want to call the carrier of the paging apparatus in different ways under various circumstances. For example, a caller may want to call the carrier without being noticed by others, or call the carrier in case of emergency, or call the carrier to tell him some other matters.

Such a call is made in a call type which has been selected by the carrier for the paging apparatus. Therefore, when a caller wishes to make a call to the carrier of the paging apparatus without being noticed by others near the carrier, the paging receiver may output a special sound or a melody, allowing the others to know the call. Call types are selected by the carrier of the paging apparatus, and a call type based on a selected sound does not permit the carrier to determine the intention of the caller. Stated otherwise, unless the carrier sees a message displayed on the LCD 7, the carrier cannot determine the intention of the caller, e.g., an urgent request to make a telephone call. In places where it is difficult for the carrier to see a display on the LCD 7, e.g., a crowded train, the carrier finds it troublesome to confirm the call.

The present invention has been made to solve the above conventional problems. It is an object of the present invention to provide a paging apparatus which can automatically determine a call to allow the carrier to determine the intention of a caller easily and reliably without seeing a displayed message, can automatically vary the volume of a calling sound based on an ambient sound or light, can freely confirm and change the melodies of call types, and is highly convenient to use.

SUMMARY OF THE INVENTION

To achieve the above object, according to the invention, there is provided a selective call receiver for making a call (providing a page) when an individual number or an identification code obtained from a paging signal from a base station which includes the identification number and a message is addressed to the paging apparatus, comprising memory means for storing calling process determining information or page type corresponding to predetermined call switching messages, detecting means for detecting a call switching message or page type code from the message obtained from the paging signal if the individual number obtained from the paging signal is addressed to the paging apparatus, and calling means for making a call suggestive of a given matter based on the stored calling process determining information corresponding to the call switching message which agrees with a call switching message if the last-mentioned call switching message is detected by the detecting means.

In the paging apparatus of the present invention, the call which is made by the calling means as being suggestive of a given matter is made by transmitting a melody.

In another embodiment, the paging apparatus further comprises a manual switch and second memory means for storing a message, wherein if a given input is entered by the manual switch after a first call has been made in response to the reception of the paging signal, the calling means makes a call suggestive of the same matter as the matter suggested by the first call, based on the message stored in the second memory means.

In another embodiment, the paging apparatus further comprises sound detecting means for detecting an ambient sound around the paging apparatus, and an automatic volume varying means for automatically varying the volume of a calling sound from the calling means when the sound detecting means detects an ambient sound equal to or higher than a predetermined threshold.

In another embodiment, the paging apparatus further comprises light detecting means for detecting ambient light around the paging apparatus, and an automatic volume varying means for automatically varying the volume of a calling sound from the calling means when the light detecting means detects an ambient light level equal to or higher than a predetermined threshold.

In another embodiment, the paging apparatus further comprises setting/canceling means for setting or canceling operation of the light detecting means and/or the automatic volume varying means.

In another embodiment, the paging apparatus defined in the automatic volume varying means includes means for automatically setting a call from the calling means to an increased volume when an ambient light level equal to or higher than the predetermined threshold is detected, and automatically setting a call from the calling means to a decreased volume when an ambient light level lower than the predetermined threshold is detected, and setting reversal means for reversing the setting made by the means.

In another embodiment, the paging apparatus defined in the calling means includes a melody integrated circuit for transmitting a melody, the melody integrated circuit being replaceably installed on the paging apparatus.

In another embodiment, the paging apparatus further comprises stop means for stopping transmission of a melody after transmitting the melody from the calling means for a predetermined period of time, and setting means for setting a change of the predetermined period of time for which the melody is transmitted until stopped by the stop means.

In another embodiment, the paging apparatus further comprises time display means for displaying on a screen the predetermined period of time set by the setting means and for which the melody is transmitted until stopped by the stop means.

In another embodiment, the paging apparatus further comprises timing means for measuring time, display means for displaying time, starting time setting means for setting a starting time to enable the calling means to start transmitting a melody, stop time setting means for setting a stopping time to stop transmitting the melody from the calling means, memory means for storing the starting and stopping times, and control means for controlling the calling means to start transmitting the melody at the stored staring time and to stop transmitting the melody at the stored stopping time.

In another embodiment, the paging apparatus further comprises display setting means for reading the stored starting and stopping times and displaying the starting and stopping times on the display means.

In another embodiment, the paging apparatus further comprises melody operation setting means for making a setting to output a melody from the calling means to confirm the content of the melody outputted from the calling means.

In another embodiment, the paging apparatus further comprises melody selecting and setting means for selectively making a setting to output one of a plurality of melodies which can be outputted by the calling means.

In another embodiment the calling means comprises display means for displaying characters of the message on a screen, vibration transmitting means for transmitting the call by way of vibration, sound producing means for outputting and indicating the call by way of sound, light producing means for outputting and indicating the call by way of light, and melody producing means for outputting and indicating the call by way of a melody.

In another embodiment, the paging apparatus further comprises setting means for selecting either one or a combination of the vibration transmitting means, the sound producing means, the light producing means, and the melody producing means, and setting the selected one or combination as indicating the call in combination with the indication of the melody by the melody producing means.

In another embodiment, the paging apparatus includes information for determining call types corresponding predetermined call switching messages is stored, and if an identification number obtained from a paging signal is addressed to the paging apparatus, a call switching message is detected from a message which is obtained from the paging signal. The paging apparatus makes a call suggestive of a given matter based on the stored information for determining the call type which agrees with the call switching message. Therefore, the caller's intention of the call is automatically determined by the paging apparatus, allowing the carrier of the paging apparatus to easily and reliably recognize the caller's intention without viewing a displayed message.

The paging apparatus according to the invention, is convenient to use because it detects an ambient sound or light and automatically varies the volume of a calling sound depending on the detected level of ambient sound or light.

The paging apparatus according to the invention permits a melody integrated circuit (IC) to be replaced or modified, varies the time at which the transmission of a melody is stopped, and reads melodies for confirming tunes. Therefore, the paging apparatus allows the carrier to easily confirm the melodies of call types, allows melodies to be changed, and hence is highly convenient to use.

BRIEF DESCRIPTION OF THE DRAWINGS

The present invention will be better understood from the following detailed description and the accompanying drawings which illustrate preferred embodiments of the present invention. The embodiments illustrated in the accompanying drawings are not intended to limit the present invention, but merely serve to facilitate the description and understanding of the present invention.

FIG. 4 is a diagram of a table which shows the relationship between call switching messages and call types which are stored in a memory shown in FIG. 3;

FIG. 5 is a flowchart of a processing sequence of a calling control process in the operation according to the first embodiment;

FIG. 7 is a flowchart of a processing sequence for detecting an ambient noise and automatically adjusting the volume of a calling sound in the operation according to the second embodiment;

DETAILED DESCRIPTION OF THE PREFERRED EMBODIMENTS

Figure 1:
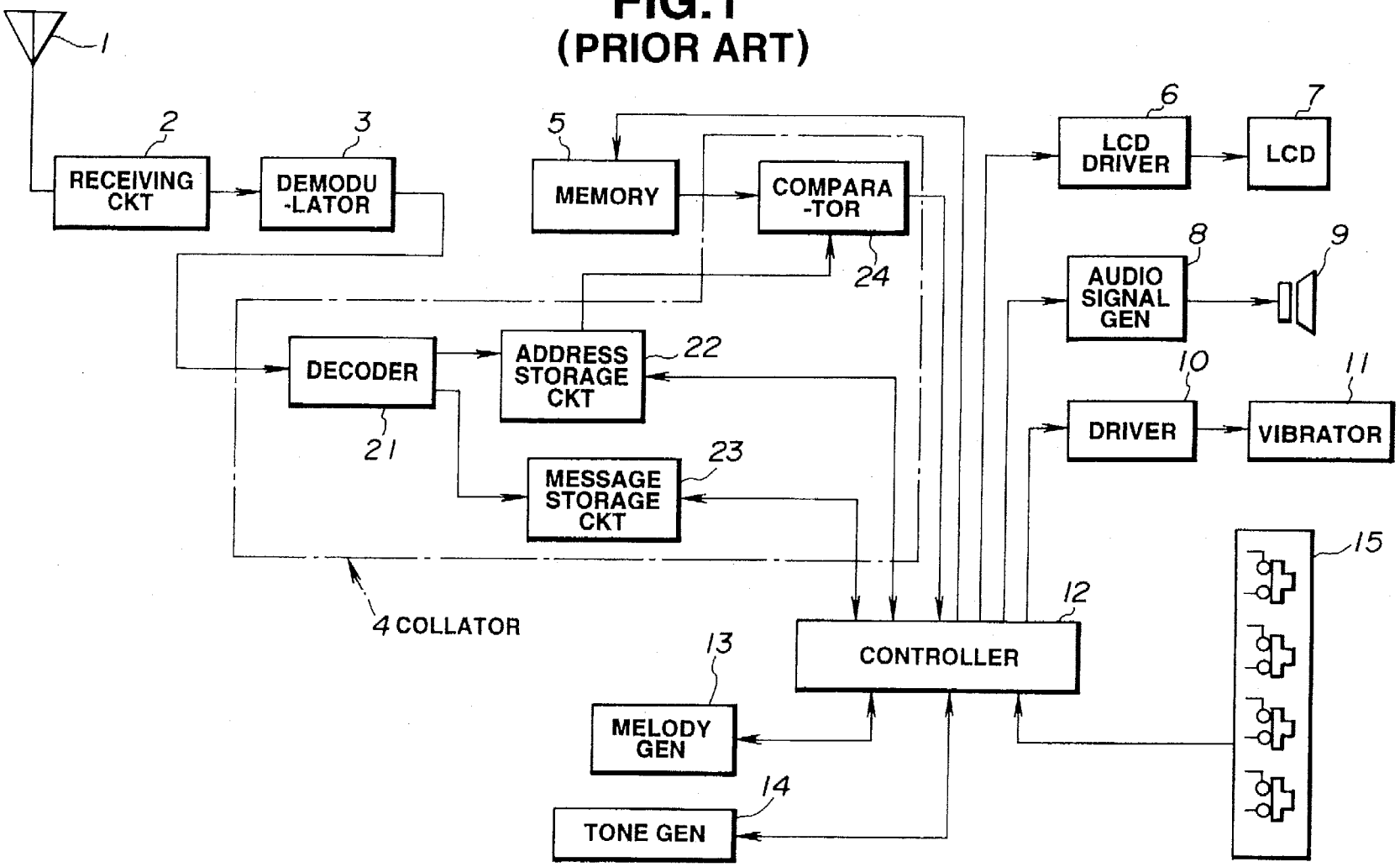
FIG.1 (PRIOR ART)
FIG. 1 is a block diagram of an arrangement of a conventional paging apparatus.

Paging apparatus according to preferred embodiments of the present invention will be described below with reference to FIGS. 2–9. Those parts referred to in the following description and shown in the drawings which are identical to those shown in FIG. 1 are denoted by identical reference numerals.

Figure 2:
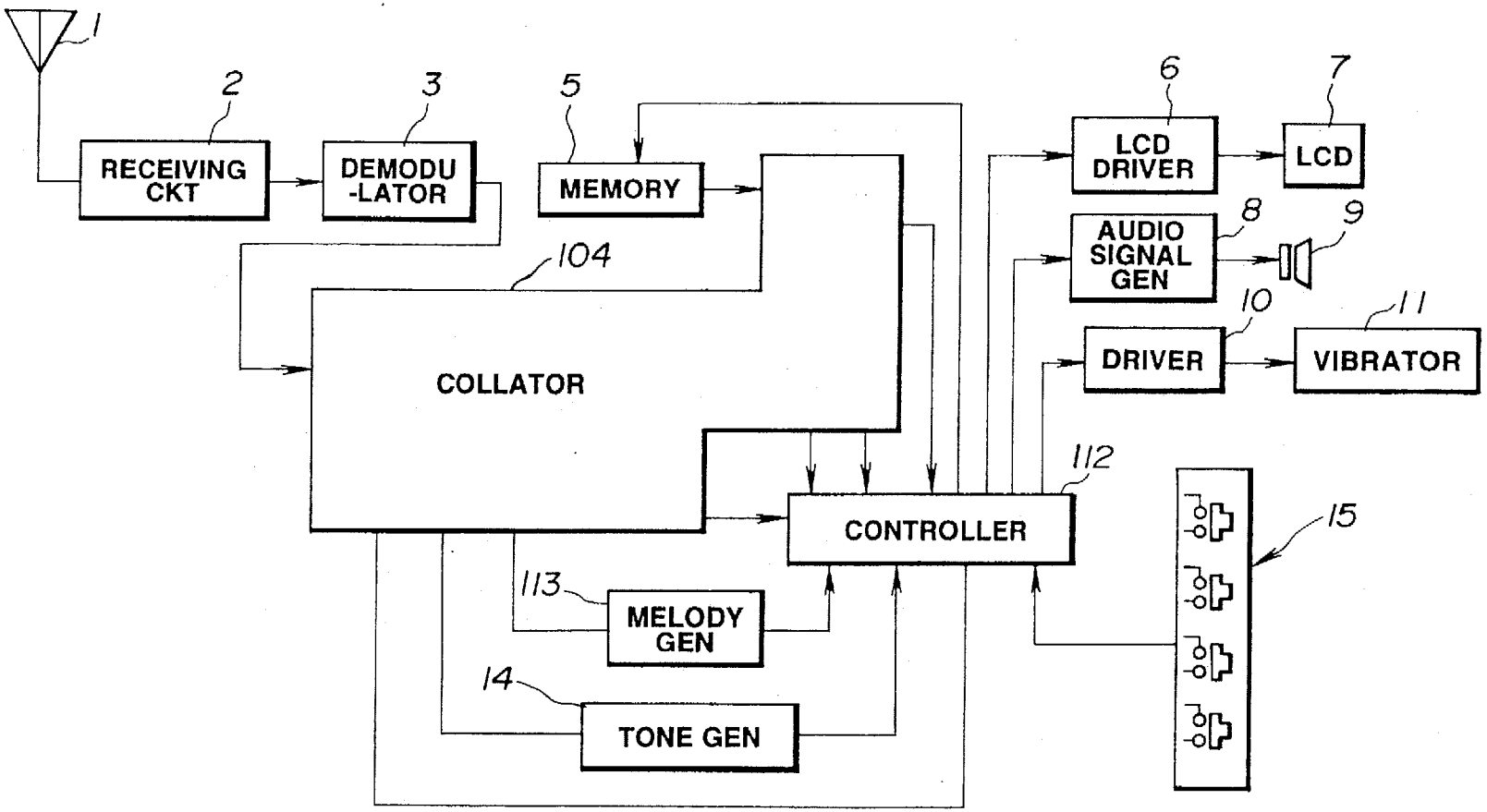
FIG. 2 is a block diagram of an arrangement of a paging apparatus according to a first embodiment of the present invention.

FIG. 2 is a block diagram of an arrangement of a paging apparatus according to a first embodiment of the present invention. In FIG. 2, the paging receiver according to the first embodiment has an antenna 1 for receiving a radio wave transmitted from a base station (not shown), a receiving circuit 2 for outputting an intermediate-frequency signal frequency-converted from a received signal from the antenna 1, and a demodulator 3 for demodulating the received signal outputted from the receiving circuit 2. The paging apparatus also has a collator 104 for determining whether the received signal is addressed to the present selective call receiver, and also determining a call type indicated by the caller, a memory 5 for storing the identification number of the present paging apparatus, an LCD driver 6 for outputting a drive signal to display a message on an LCD, and an LCD 7 for displaying a message.

The paging apparatus according to this embodiment also includes an audio signal generator 8 for generating and outputting an audio signal to be outputted by a speaker, a speaker 9 for outputting a special sound such as an intermittent sound, a melody, or the like, a driver 10 for actuating a vibrator, and a vibrator 11 for producing and transmitting a vibration to the carrier of the paging apparatus. The paging apparatus further includes a controller 112 for effecting a calling control process for the carrier based on data of a call type which has been indicated by the caller through a public radio wave communication network, a melody generator 113 for generating various melody data, a tone generator 14 for generating a special sound such as an intermittent sound, and switches 15 for selecting call types of a special sound, a vibration, a melody, and a display, indicating the reading of a melody stored in the melody generator 113 for confirming the melody, and setting an adjustment of the volume of a calling sound.

Figure 3:
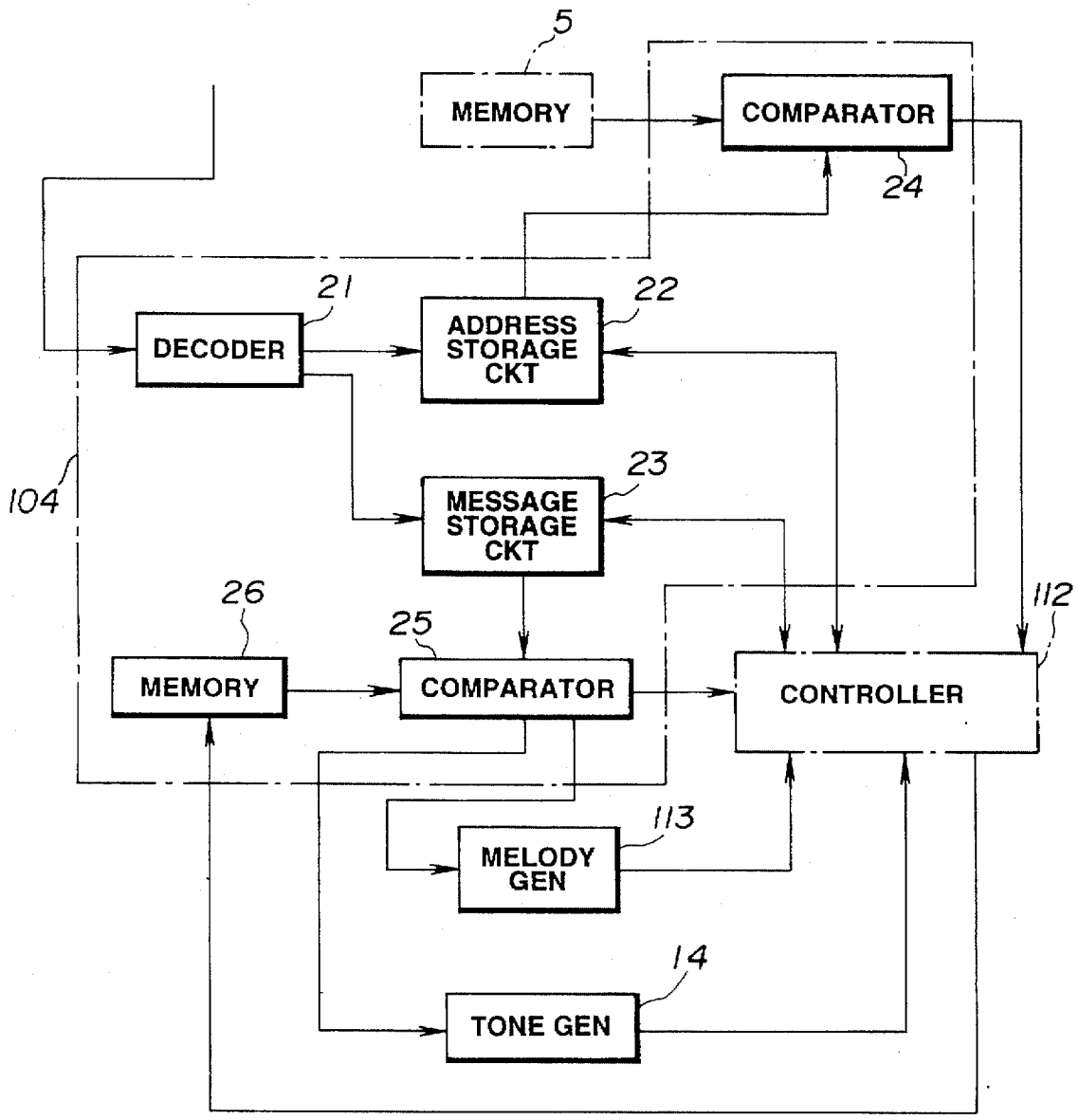
FIG. 3 is a block diagram of a detailed arrangement of a collator shown in FIG. 2.

FIG. 3 is a block diagram of a detailed arrangement of the collator shown in FIG. 2. In FIG. 3, the collator 104 comprises a decoder 21 for analyzing a paging signal which has been inputted, an address storage circuit 22 for storing a received identification number, a message storage circuit 23 for storing a received message, and a comparator 24 for comparing the contents stored in the address storage circuit 22 and the contents stored in the memory 5. The collator 104 also includes a comparator 25 for comparing a call switching message stored in the message storage circuit 23 and the contents stored in a memory 26, and the memory 26 for storing data representing the relationship between call switching messages and call types.

FIG. 4 is a diagram of a table which shows the relationship between call switching messages and call types which are stored in the memory shown in FIG. 3. In FIG. 4, a call switching message or a page type code "- 0" indicates a call type representing a vibration produced by the vibrator 11, and a call switching message "- 1" indicates a call type representing a special sound generated by the tone generator 14. Call switching messages "- 2"–"- 9" indicate page types representing melodies produced by the melody generator 113. Therefore, call switching messages can indicate the generation of the melodies of different tunes. These melodies are of sufficient contents to associate themselves with respective given matters. For example, if a message "Come back" is to be sent, then a call is made with a melody of a tune "Come back", and if a message "Waiting" is to be sent, then a call is made with a melody of a tune "I wait". Foreign tunes may also be used. For example, if a message "Come because I want you to be by my side" is to be sent, then a call is made with a melody of a tune "Stand by me", and if a message "Help me" is to be sent, then a call is made with a melody of a tune "Help". If a message "Get back" is to be sent, then a call is made with a melody of a tune "Get back", and if a message "Call me" is to be sent, then a call is made with a melody of a tune "Call me".

Therefore, when calls are made with melodies well known in a country in which the paging apparatus is used, and calls are made in a country with melodies suitable for people in that country and with melodies suitable for people in other countries, those calls can reliably and quickly be identified by the carrier.

Operation of the first embodiment will be described below.

A radio wave transmitted from a base station (not shown) is received through the antenna 1 by the receiving circuit 2, and the received signal from the receiving circuit 2 is demodulated by the demodulator 3, which outputs a selective call signal. The paging signal is applied to the decoder 21 in the collator 104. The decoder 21 produces an identification number by analyzing the inputted paging signal, and stores the identification number in the address storage circuit 22. The decoder 21 also stores an analyzed message in the message storage circuit 23. The comparator 24 compares the identification number stored in the address storage circuit 22 with the identification number of the paging apparatus which is stored in the memory 5. If the compared identification numbers agree with each other, the comparator 24 outputs an identification signal indicating that a call has been made, and the message in the message storage circuit 23 is displayed by the LCD 7 through the LCD driver 6. When the identification signal from the comparator 24 is supplied to the controller 12, the controller 12 effects a control process based on a call type indicated by the caller or pager-specified page type.

FIG. 5 is a flowchart of a processing sequence of such a calling control process. First, the above calling process is carried out in a step (indicated by "S" in FIG. 5) 400. Then, a call is determined in a step 401. If there is a call (YES), i.e., if the identification signal from the comparator 24 is supplied to the controller 112, then control goes to a step 402 which determines whether the first character of the message stored in the message storage circuit 23 is "-" or not. If it is "-" (YES), then control proceeds to a step 403. If there is no "-" (NO), then control goes to a step 404 in which the calling control process is stopped, and the processing sequence is ended.

If the first character of the message is "-" in the step 402, then it is determined whether the character following "-" is any one of "0"–"9" or not in the step 403 and following steps. If the character following "-" is "0", then the table shown in FIG. 4 which is stored in the memory 26 is referred to, and control goes to a step 405 in which the driver 10 is instructed to actuate the vibrator 11 to produce a vibration.

A step 406 determines whether the first and next characters are "- 1". If "- 1" (YES), then the table shown in FIG. 4 which is stored in the memory 26 is referred to, and control goes to a step 407 in which the controller 112 instructs the audio signal generator 8 to output special sound data such as of an intermittent sound read from the tone generator 14, as a sound from the speaker 9. If not "- 1" (NO) in the step 406, then a next step 408 determines whether the first and next characters are "- 2". If "- 2" (YES) in the step 408, then the table shown in FIG. 4 which is stored in the memory 26 is referred to, and control goes to a step 409 in which the controller 112 instructs the audio signal generator 8 to output a melody (tune 1) read from the melody generator 113, as a sound from the speaker 9. If not "- 2" (NO) in the step 408, then a next step 410 determines whether the first and next characters are "- 3". If "- 3" (YES) in the step 410, then the table shown in FIG. 4 which is stored in the memory 26 is referred to, and control goes to a step 411 in which the controller 112 instructs the audio signal generator 8 to output a melody (tune 2) read from the melody generator 13, as a sound from the speaker 9. If not "- 3" (NO) in the step 410, then a next step 412 determines whether the first and next characters are "- 4".

If "- 4" (YES) in the step 412, then the table shown in FIG. 4 which is stored in the memory 26 is referred to, and control goes to a step 413 in which the controller 112 instructs the audio signal generator 8 to output a melody (tune 3) read from the melody generator 113, as a sound from the speaker 9. If not "- 4" (NO) in the step 412, then a next step 414 determines whether the first and next characters are "- 5". If "- 5" (YES) in the step 414, then the table shown in FIG. 4 which is stored in the memory 26 is referred to, and control goes to a step 415 in which the controller 112 instructs the audio signal generator 8 to output a melody (tune 4) read from the melody generator 113, as a sound from the speaker 9. If not "- 5" (NO) in the step 414, then a next step 416 determines whether the first and next characters are "- 6". If "- 6" (YES) in the step 416, then the table shown in FIG. 4 which is stored in the memory 26 is referred to, and control goes to a step 417 in which the controller 12 instructs the audio signal generator 8 to output a melody (tune 5) read from the melody generator 113, as a sound from the speaker 9. If not "- 6" (NO) in the step 416, then a next step 418 determines whether the first and next characters are "- 7".

If "- 7" (YES) in the step 418, then the table shown in FIG. 4 which is stored in the memory 26 is referred to, and control goes to a step 419 in which the controller 12 instructs the audio signal generator 8 to output a melody (tune 6) read from the melody generator 113, as a sound from the speaker 9. If not "- 7" (NO) in the step 418, then a next step 420 determines whether the first and next characters are "- 8". If "- 8" (YES) in the step 420, then the table shown in FIG. 4 which is stored in the memory 26 is referred to, and control goes to a step 421 in which the controller 112 instructs the audio signal generator 8 to output a melody (tune 7) read from the melody generator 113, as a sound from the speaker 9. If not "- 8" (NO) in the step 420, then a next step 422 determines whether the first and next characters are "- 9".

If "- 9" (YES) in the step 422, then the table shown in FIG. 4 which is stored in the memory 26 is referred to, and control goes to a step 423 in which the controller 112 instructs the audio signal generator 8 to output a melody (tune 8) read from the melody generator 113, as a sound from the speaker 9. Then, the processing sequence is brought to an end.

Unless the switches 15 are operated within a certain period of time after the above calling control process is effected, an automatic resetting process is carried out to automatically stop the call upon elapse of a certain period of time. The call is registered as a non-call message in the address storage circuit 22 and the message storage circuit 23. When the switches 15 are operated, the same melody is generated from the speaker 9. For displaying a message on the LCD 7 at a desired time through operation of the switches 15, if the message has a call switching message, then a melody corresponding to the call switching message is generated from the speaker 9.

According to the first embodiment, as described above, simply by adding a call switching message indicative of a call type to be used on a paging apparatus to the beginning end of a message that is inputted when a caller calls the paging apparatus having a desired number from a telephone set, the call type to be used on the selective call receiver can be indicated, and the caller can call the carrier of the paging apparatus with the call type which matches the intention of the caller. Therefore, if the caller wants to send a message "Come back" to the carrier, then the caller sends a call switching message for generating a melody of a tune "Come back". When the carrier listens to the generated melody, the carrier knows the caller's intention "Come back", and does not need to view a display on the LCD 7.

If the caller wants to call the carrier without being noticed by others around the paging apparatus, the caller may indicate a vibration produced by the vibrator 11 as a call type. If the caller wants to call the carrier in case of emergency, the caller may indicate a special sound. In this case, the carrier is not required to view a message displayed on the LCD 7. Therefore, even when the carrier does not want to take the trouble of viewing a display on the LCD 7 in a crowded train, for example, the caller's intention of the call can be transmitted to the carrier. Furthermore, even when the carrier cannot confirm a call because the carrier is not carrying the paging apparatus but leaving it somewhere, and hence the call is automatically reset, the same melody as when the call is made can be outputted by subsequently operating the switches. Thus, the caller's intention of the call can reliably be transmitted to the carrier. In this case, a number of different messages can be transmitted to a paging apparatus even if the paging apparatus has no message display unit. The above process can easily be carried out without having to modify the hardware or software of the caller's telephone set at all.

A second embodiment will be described below.

On the paging apparatus, the volume of a calling sound of a melody and a special sound produced by the speaker 9 can be set by the switches 15. According to the second embodiment, an ambient noise or light (day or night) is determined. If the ambient noise is large, then the volume of a calling sound from the speaker 9 is automatically increased, and if the ambient noise is small, the volume of a calling sound from the speaker 9 is automatically decreased. If the ambient light is bright, then the volume of a calling sound from the speaker 9 is automatically decreased, and if the ambient light is dark, then the volume of a calling sound from the speaker 9 is automatically increased. An opposite setting may be made, e.g., if the paging apparatus is put in a dark place such as a bag, then the volume of a calling sound from the speaker 9 is automatically increased.

Figure 6:
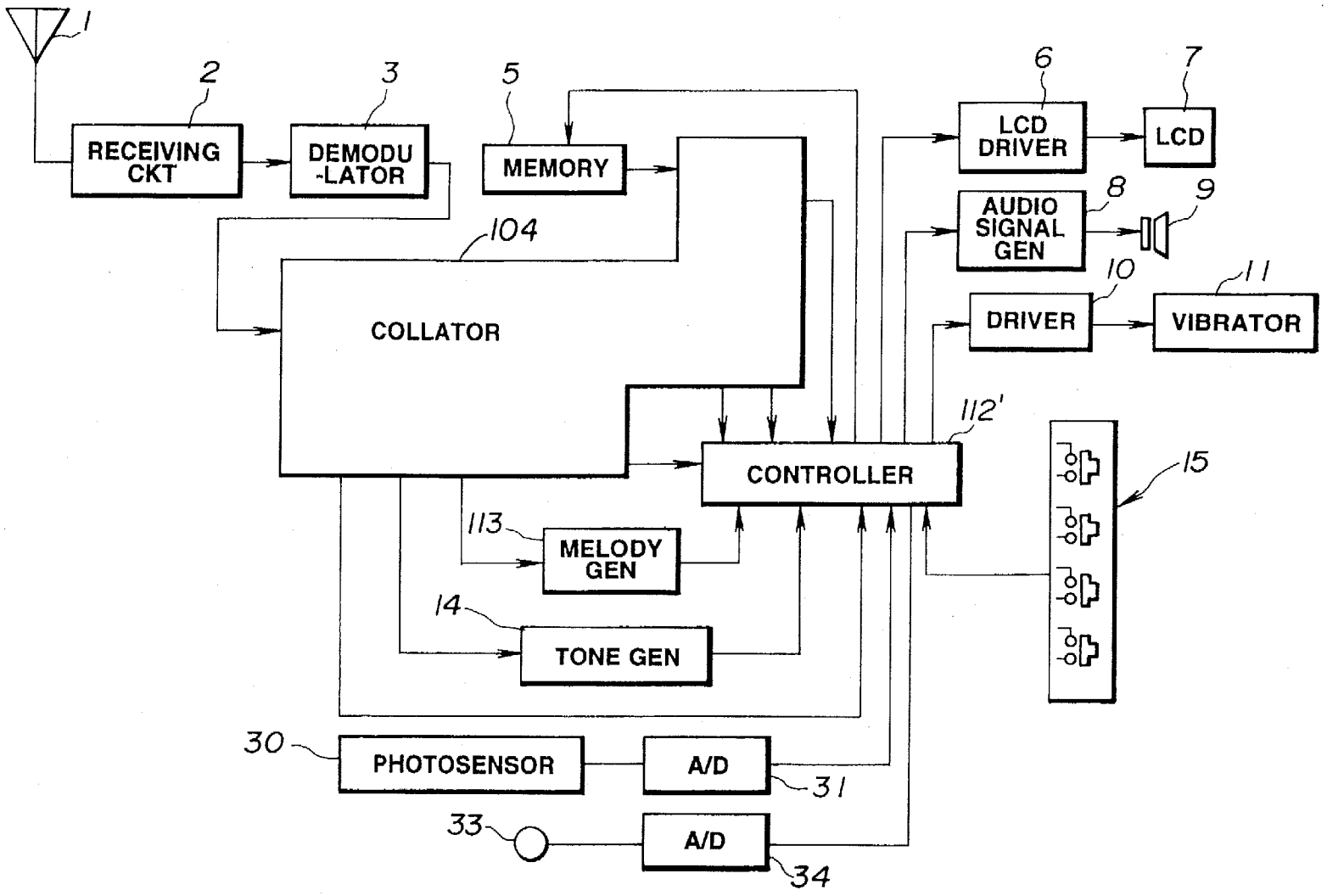
FIG. 6 is a block diagram of an arrangement according to a second embodiment for automatically adjusting the volume of a calling sound.

FIG. 6 is a block diagram of an arrangement according to a second embodiment for automatically adjusting the volume of a calling sound. In FIG. 6, the second embodiment includes a photosensor 30 for detecting ambient light, an A/D converter for converting a detected signal from the photosensor 30 into a digital signal and outputting the digital signal to the controller 112', a microphone 33 for detecting an ambient noise, and an A/D converter 34 for converting a detected signal from the microphone 33 into a digital signal and outputting the digital signal to the controller 112'. The other structural details of the second embodiment are identical to those of the first embodiment. Operation of the second embodiment will be described below.

FIG. 7 is a flowchart of a processing sequence for detecting an ambient noise and automatically adjusting the volume of a calling sound from the speaker 9. In FIGS. 6 and 7, the controller 12 carries out the same process as the steps 400–405 shown in FIG. 5. First, the calling process is carried out in a step 500. Then, a call is determined in a step 501. If there is a call (YES), then control goes to a step 502 which determines whether the first character of the message stored in the message storage circuit 23 is "-" or not. If it is "-" (YES), then control proceeds to a step 503. If there is no "-" (NO), then control goes to a step 504 in which the calling control process is stopped, and the processing sequence is ended. If the first character of the message is "-" in the step 502, then it is determined whether the character following "-" is any one of "0"–"9" or not and the volume of a calling sound is automatically adjusted based on the detection of an ambient noise in the step 503 and following steps. The step 503 determines whether the character following "-" is "0" or not. If the character following "-" is "0" (YES), then the table shown in FIG. 4 which is stored in the memory 26 is referred to, and control goes to a step 505 in which the driver 10 is instructed to actuate the vibrator 11 to produce a vibration.

A step 506 determines whether the first and next characters are "- 1". If "- 1" (YES), then control goes to a step 507 in which an automatic adjustment setting for the volume of a calling sound based on the detection of an ambient noise is read from a RAM (not shown) in the controller 12. Thereafter, a step 508 determines whether there is an automatic adjustment setting for the volume of a calling sound or not. If there is no automatic adjustment setting for the volume of a calling sound based on the detection of an ambient noise (NO) in the step 508, then the table shown in FIG. 4 which is stored in the memory 26 is referred to, and control goes to a step 509 in which the controller 12 instructs the audio signal generator 8 to output special sound data such as of an intermittent sound read from the tone generator 14, as a sound from the speaker 9.

If there is an automatic adjustment setting for the volume of a calling sound based on the detection of an ambient noise (YES) in the step 508, then the controller 12 introduces a detected signal from the microphone 33 through the A/D converter 34 in a step 510. Then, a step 511 compares the level of the detected signal of an ambient noise with a threshold "x" set in the non-illustrated RAM in the controller 12. The threshold "x" is established such that when the detected ambient noise level "m" exceeds the threshold "x", the speaker 9 produces an output sound which can be heard sufficiently even in the presence of the ambient noise. If the detected ambient noise level "m" exceeds the threshold "x" (YES) in the step 511, then the controller 112' makes a setting to instruct the audio signal generator 8 to output a special sound at an increased volume from the speaker 9 in a step 512. Such a setting may be made by adjusting an electronic volume control unit (not shown) in the audio signal generator 8. Thereafter, the controller 112' instructs the audio signal generator 8 to output special sound data such as of an intermittent sound read from the tone generator 14, as a sound from the speaker 9 in a step 513. Therefore, a special sound is outputted at the increased volume set by the audio signal generator 8 from the speaker 9 in a step 514. Thereafter, the calling control process is ended.

If the detected ambient noise level "m" does not exceed the threshold "x" (NO) in the step 511, then since the ambient noise is low, the controller 12 makes a setting to instruct the audio signal generator 8 to output a special sound at a decreased volume from the speaker 9 in a step 515. Such a setting may be made by adjusting an electronic volume control unit (not shown) in the audio signal generator 8. Thereafter, the controller 112' instructs the audio signal generator 8 to output special sound data such as of an intermittent sound read from the tone generator 14, as a sound from the speaker 9 in a step 516. Therefore, a special sound is outputted at the decreased volume set by the audio signal generator 8 from the speaker 9 in a step 517.

Rather than outputting the two sounds, i.e., larger and smaller sounds, the sound outputted from the speaker 9 may be continuously varied so as to increase monotonously depending on the detected ambient noise level "m".

If not "- 1" (NO) in the step 506, then control goes to a step 518 which determines whether the first and next characters are "- 2". If "- 2" (YES), then the processing in case of "- 2" is carried out in the same manner as in case of "- 1". Specifically, the steps 507–517 are carried out, and the controller 112' reads the data of the melody (tune 1) shown in FIG. 4 from the melody generator 113, and instructs the audio signal generator 8 to output the data as a melody sound at an increased or decreased volume from the speaker 9.

If not "- 2" (NO) in the step 518, then control goes to a step 519 which determines whether the first and next characters are "- 3". If "- 3" (YES), then the processing in case of "- 3" is carried out in the same manner as in case of "- 1". Specifically, the steps 507–517 are carried out, and the controller 112' instructs the audio signal generator 8 to output the data of the melody (tune 2) as a melody sound at an increased or decreased volume from the speaker 9. Similarly, a step 520 determines whether the first and next characters are "- 4", and outputs the data of the melody (tune 3) as a melody sound at an increased or decreased volume from the speaker 9 through the audio signal generator 8.

A step 521 determines whether the first and next characters are "- 5", and outputs the data of the melody (tune 4) as a melody sound at an increased or decreased volume. A step 522 determines whether the first and next characters are "- 6", and outputs the data of the melody (tune 5) as a melody sound at an increased or decreased volume. A step 523 determines whether the first and next characters are "- 7", and outputs the data of the melody (tune 6) as a melody sound at an increased or decreased volume. A step 524 determines whether the first and next characters are "- 8", and outputs the data of the melody (tune 7) as a melody sound at an increased or decreased volume. Thereafter, a step 525 determines whether the first and next characters are "- 9", and outputs the data of the melody (tune 8) as a melody sound at an increased or decreased volume. Then, the calling control process comes to an end.

Figure 8:
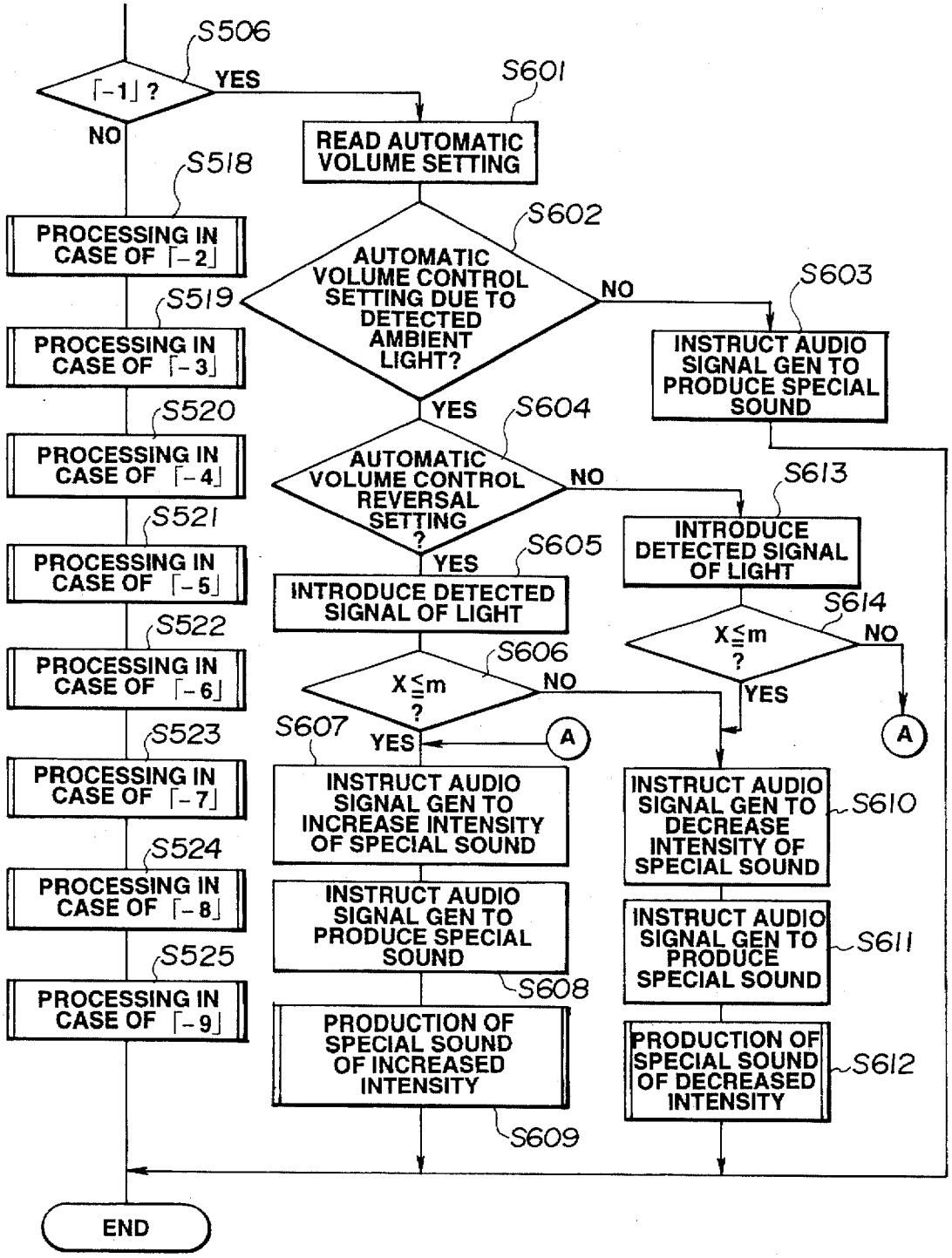
FIG. 8 is a flowchart of a processing sequence for detecting ambient light and automatically adjusting the volume of a calling sound in the operation according to the second embodiment.

FIG. 8 is a flowchart of a processing sequence for detecting ambient light and automatically adjusting the volume of a calling sound from the speaker 9. In FIGS. 6 and 8, the controller 12 carries out the same process as the steps 500–506 shown in FIG. 7. Thereafter, the controller 112' detects ambient light, and carries out a process of automatically adjusting the volume of a calling sound from the speaker 9, as encircled by dot-and-dash lines in FIG. 8.

The step 506 determines whether the first and next characters are "- 1". If "- 1" (YES), then control goes to a step 601 in which an automatic adjustment setting for the volume of a calling sound based on the detection of ambient light is read from a RAM (not shown) in the controller 112'. Thereafter, a step 602 determines whether there is an automatic adjustment setting for the volume of a calling sound or not. If there is no automatic adjustment setting for the volume of a calling sound based on the detection of ambient light (NO) in the step 602, then the table shown in FIG. 4 which is stored in the memory 26 is referred to, and control goes to a step 603 in which the controller 112' instructs the audio signal generator 8 to output special sound data such as of an intermittent sound read from the tone generator 14, as a sound from the speaker 9.

If there is an automatic adjustment setting for the volume of a calling sound based on the detection of ambient light (YES) in the step 602, then a step 604 determines whether there is a setting for reversal of automatic volume adjustment based on the detected ambient light. Specifically, in a normal setting, the sound outputted from the speaker 9 is automatically adjusted to an increased volume when the ambient light is bright, and the sound outputted from the speaker 9 is automatically adjusted to a decreased volume when the ambient light is dark. In a reversal setting, the sound outputted from the speaker 9 is automatically adjusted to a decreased volume when the ambient light is bright, and the sound outputted from the speaker 9 is automatically adjusted to an increased volume when the ambient light is dark. The reversal setting is used to automatically adjust the sound outputted from the speaker 9 to an increased volume for the carrier to reliably hear the sound when the paging apparatus is detected as being put in a dark place such as a bag.

If there is a normal setting (YES) in the step 604, then the controller 112' introduces a detected signal from the photosensor 30 through the A/D converter 31 in a step 605. Then, a step 606 compares the level of the detected signal of ambient light with a threshold "x" set in the non-illustrated RAM in the controller 112'.

If the detected ambient light level "m" not exceed the threshold "x" (YES) in the step 606, then the controller 112' makes a setting to instruct the audio signal generator 8 to output a special sound at an increased volume from the speaker 9 in a step 607. Such a setting may be made by adjusting an electronic volume control unit (not shown) in the audio signal generator 8. Thereafter, the controller 112' instructs the audio signal generator 8 to output special sound data such as of an intermittent sound read from the tone generator 14, as a sound from the speaker 9 in a step 608. Therefore, a special sound is outputted at the increased volume set by the audio signal generator 8 from the speaker 9 in a step 609. Thereafter, the calling control process is ended.

If the detected ambient light level "m" does exceeds the threshold "x" (NO) in the step 606, then since the ambient light is dark, the controller 112' makes a setting to instruct the audio signal generator 8 to output a special sound at a decreased volume from the speaker 9 in a step 610. Such a setting may be made by adjusting an electronic volume control unit (not shown) in the audio signal generator 8. Thereafter, the controller 112' instructs the audio signal generator 8 to output special sound data such as of an intermittent sound read from the tone generator 14, as a sound from the speaker 9 in a step 611. Therefore, a special sound is outputted at the decreased volume set by the audio signal generator 8 from the speaker 9 in a step 612.

Since a special sound is produced by the speaker 9 automatically at a reduced volume when the paging receiver is used in a quiet place at dark night, it is convenient to use the paging apparatus.

Rather than outputting the two sounds, i.e., larger and smaller sounds, the sound outputted from the speaker 9 may be continuously varied so as to increase monotonously depending on the detected ambient light level "m".

If there is a setting for reversal of automatic volume adjustment based on the detected ambient light in the step 604, then the controller 112' introduces a detected signal from the photosensor 30 through the A/D converter 31 in a step 613. Then, a step 614 compares the level of the detected signal of ambient light with a threshold "x" set in the non-illustrated RAM in the controller 12.

If the detected ambient light level "m" exceeds the threshold "x" (YES) in the step 614, i.e., if the ambient light is bright, then the controller 112' carries out the steps 610 through 612 to output a special sound at a decreased volume from the speaker 9. Thereafter, the calling control process comes to an end. If the detected ambient light level "m" does not exceed the threshold "x" (NO) in the step 614, i.e., if the ambient light is dark, then the controller 112' carries out the steps 607 through 609 to output a special sound at an increased volume from the speaker 9. Thereafter, the calling control process comes to an end. In the automatic volume control reversal setting, therefore, the special sound is outputted at the decreased volume from the speaker 9 when the ambient light is bright, and at the increased volume from the speaker 9 when the ambient light is dark. It is convenient to use the reversal setting if the calling sound cannot clearly be heard by the carrier as when the paging apparatus is placed in a dark space in a bag.

If not "- 1" (NO) in the step 506, then control goes to a step 518 which determines whether the first and next characters are "- 2". If "- 2" (YES), then the processing in case of "- 2" is carried out in the same manner as in case of "- 1". Specifically, the steps 601–614 are carried out, and the controller 112' reads the data of the melody (tune 1) shown in FIG. 4 from the melody generator 113, and instructs the audio signal generator 8 to output the data as a melody sound at an increased or decreased volume from the speaker 9. Specifically, the ambient light is detected, and the melody is outputted from the speaker 9 at an increased volume when the ambient light is bright in the normal setting, and at a decreased volume when the ambient light is dark in the normal setting. In the reversal setting, the melody is outputted from the speaker 9 at a decreased volume when the ambient light is bright, and at an increased volume when the ambient light is dark.

If not "- 2" (NO) in the step 518, then control goes to a step 519 which determines whether the first and next characters are "- 3". If "- 3" (YES), then the processing in case of "- 3" is carried out in the same manner as in case of "- 1". Specifically, the steps 601–614 are carried out, and the controller 112' instructs the audio signal generator 8 to output the data of the melody (tune 2) as a melody sound at an increased or decreased volume from the speaker 9. Similarly, a step 520 determines whether the first and next characters are "- 4", and outputs the data of the melody (tune 3) as a melody sound at an increased or decreased volume from the speaker 9 through the audio signal generator 8.

A step 521 determines whether the first and next characters are "- 5", and outputs the data of the melody (tune 4) as a melody sound at an increased or decreased volume. A step 522 determines whether the first and next characters are "- 6", and outputs the data of the melody (tune 5) as a melody sound at an increased or decreased volume. A step 523 determines whether the first and next characters are "- 7", and outputs the data of the melody (tune 6) as a melody sound at an increased or decreased volume. A step 524 determines whether the first and next characters are "- 8", and outputs the data of the melody (tune 7) as a melody sound at an increased or decreased volume. Thereafter, a step 525 determines whether the first and next characters are "- 9", and outputs the data of the melody (tune 8) as a melody sound at an increased or decreased volume. Then, the calling control process comes to an end.

Figure 9:
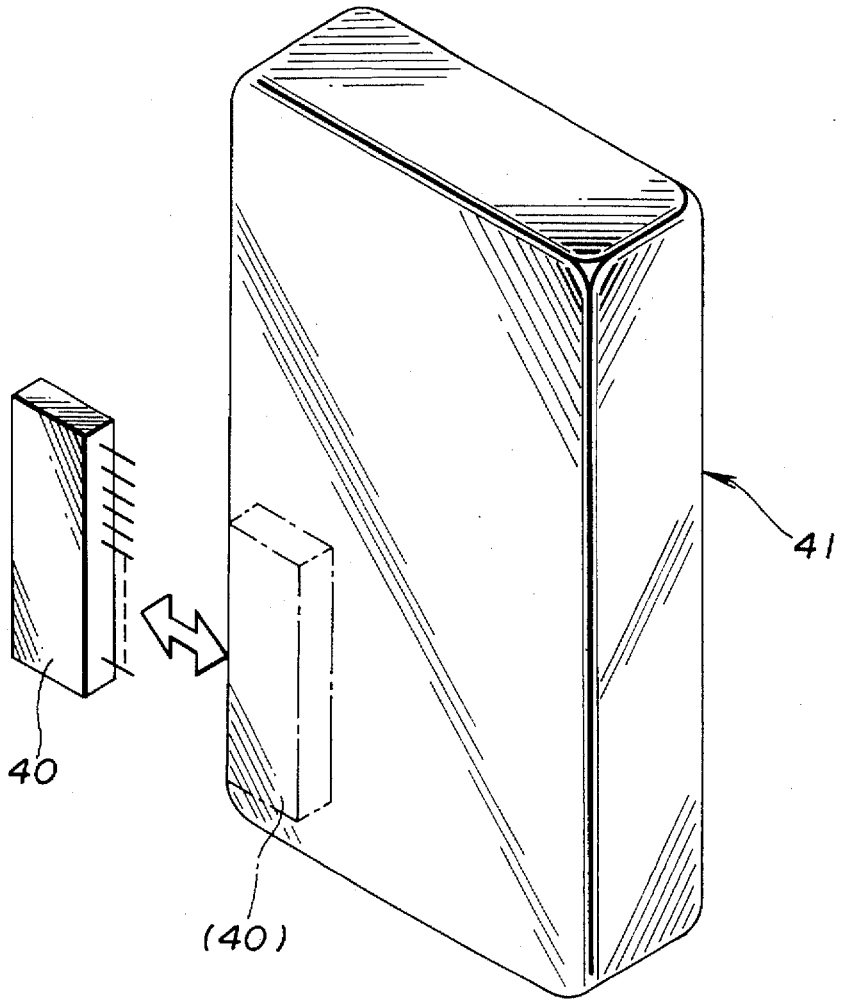
FIG. 9 is a perspective view showing the manner in which a melody IC is replaced.

FIG. 9 is a perspective view showing the manner in which a melody IC serving as the melody generator 113 is replaced. In FIG. 9, a melody IC 40 which is used as the melody generator 113 is replaceable from the outside of a selective call receiver 41. The melody IC 40 is installed by inserting pins thereof into a socket (not shown) of the selective call receiver 41. To change tunes, the installed melody IC 40 is removed, and a new melody IC 40 is mounted in place. Thereafter, the tunes stored in the melody IC 40 are successively read by the switches 15 and outputted as a sound from the speaker 9 for the carrier to confirm their melodies.

In the embodiments, call types corresponding to the call switching messages may comprise various types such as the delivery of specific predetermined messages produced by speech synthesis or the display only of messages on display unit in a silence mode.

As can be understood from the foregoing description, a paging apparatus according to claims 1–3 allows a caller to select and indicate a call type for the selective call receiver, and also allows the carrier of the selective call receiver to recognize the intention of the caller with the call type (melody) at the time a call is made.

A paging apparatus according to claims 4–7 is convenient to use because it detects an ambient sound or light and automatically varies the volume of a calling sound depending on the detected level of ambient sound or light.

A paging apparatus according to claims 8–16 permits a melody integrated circuit (IC) to be replaced or modified, varies the time at which the transmission of a melody is stopped, and reads melodies for confirming tunes. Therefore, the paging apparatus allows the carrier to easily confirm the melodies of call types, allows melodies to be changed, and hence is highly convenient to use.

Although certain illustrative embodiments of the present invention has been described, it will be obvious to those skilled in the art that various modifications, omissions, and additions may be made with respect to the disclosed embodiments without departing from the scope of the invention. Therefore, it should be understood that the present invention is not limited to the above embodiments, but is to be interpreted as covering the scope defined by the elements described in the claims and equivalents of the scope.

A paging apparatus according to the present invention is highly useful as a radio communication device for selecting various call types including special sound, vibration, melody, screen display, etc., to call a carrier of the paging apparatus through a radio communication circuit network.

We claim:

1. A paging apparatus comprising:

a receiving circuit for receiving a signal from an antenna;

decoding means for decoding the signal received by said receiving circuit and outputting an address and message data;

first memory means for storing an address assigned to said paging apparatus;

a comparator for comparing the address output from said decoding means with the address stored in said first memory means;

paging determining means for determining whether said signal is a paging signal for said paging apparatus when said comparator detects the address output from said decoding means coincides with the address stored in said first memory means;

display means for displaying information;

display controlling means for controlling said display means to display a character-string of a message corresponding to said message data output from said decoding means when said paging determining means determines that said signal is a paging signal for said paging apparatus;

paging means, having a plurality of paging sources which comprise sound sources, each sound source playing a melody corresponding to a specific message content, and a vibration source for paging using vibration;

paging instruction detecting means for detecting whether instruction information that instructs use of said paging means is included in a message data output from said decoding means when said determining means determines that said signal is a paging signal for said paging apparatus; and controlling means for controlling said paging means to use one of said sources corresponding to said instruction information when said paging instruction detecting means detects that said instruction information is included in said message data, and controlling said paging means not to use said sources when said paging instruction detecting means detects that said instruction information is not included in said message data.

2. The paging apparatus according to claim 1, further comprising sound detecting means for detecting an ambient sound level around the paging apparatus, and automatic sound level varying means for automatically varying the sound level of a sound page of said paging means when said detected ambient sound level is higher than a predetermined threshold.

3. The paging apparatus according to claim 1, further comprising light detecting means for detecting an ambient light level around the paging apparatus, and automatic sound level varying means for automatically varying the sound level of a sound page from said paging means when said light detecting means detects an ambient light level higher than a predetermined threshold.

4. The paging apparatus according to claim 3, wherein said automatic sound level varying means includes:

means for automatically increasing the sound level of a sound page of said paging means in a normal setting mode when said light detecting means detects an ambient light level higher than said predetermined threshold.

5. The paging apparatus according to claim 3, wherein said automatic sound level varying means includes:

automatic setting means for automatically decreasing said sound level of a sound page of said paging means in said normal setting mode when said light detecting means detects an ambient light level less than said predetermined threshold.

6. The paging apparatus according to claim 4, further comprising:

reverse setting means responsive to a reversal setting mode set by the user carrying said apparatus for controlling said automatic sound level varying means to automatically decrease said sound level when said light detecting means detects an ambient light level higher than said predetermined threshold.

7. The paging apparatus according to claim 5, further comprising:

reverse setting means responsive to a reversal setting mode set by the user carrying said apparatus for controlling said automatic sound level varying means to automatically increase said sound level when said light detecting means detects an ambient light level less than said predetermined threshold.

8. The paging apparatus according to claim 1, further comprising light detecting means for detecting an ambient light level around the paging apparatus, and automatic sound level varying means for automatically varying the sound level of a sound page from said paging means when said light detecting means detects an ambient light level not higher than said predetermined threshold.

9. The paging apparatus according to claim 3 or 8, further comprising setting/canceling means for setting or canceling an operation of said light detecting means and/or said automatic sound level varying means.

10. The paging apparatus according to claim 1, further comprising:

a manual switch having first and second positions; and second memory means for storing said message when said manual switch is in said first position; and output means for outputting said message stored in said second memory means when said manual switch is moved from said first position to said second position.

11. The paging apparatus according to claim 1, further comprising:

stop means for stopping the presentation of a melody a predetermined period of time after transmission of said melody by use of said sound source.

12. The paging apparatus according to claim 11, further comprising time display means for displaying the predetermined period of time.

13. The paging apparatus according to claim 11, further comprising:

changing means for changing said predetermined period of time.

14. The paging apparatus according to claim 1, further comprising:

timer means for supplying time information;

starting time setting means for setting a starting time to enable, on the basis of said time information, said paging means to provide a page;

stop time setting means for setting a stopping time to disable, on the basis of said time information, said paging means from providing said page;

starting time and stopping time memory means for storing said starting time and said stopping time; and control means for enabling said paging means to provide a page of said melody type at the stored starting time and for disabling said paging means from providing the page of said melody type at the stored stopping time.

15. The paging apparatus according to claim 14, further comprising time display means for displaying the starting time set by said starting time setting means and the stopping time set by said stop time setting means.

16. The paging apparatus according to claim 1, further comprising melody outputting means responsive to an input by said user of said paging apparatus for outputting at least one of said plurality of melodies.

17. The paging apparatus according to claim 1, wherein said paging means includes a melody integrated circuit which serves as a source of melodies, said melody integrated circuit being replaceably installed in said paging apparatus.

* * * * *